US009839310B2

(12) United States Patent
Mongeli

(10) Patent No.: US 9,839,310 B2
(45) Date of Patent: Dec. 12, 2017

(54) BEVERAGE CONTAINER ILLUMINATED AND CONTROLLED BY MOTION OR PROXIMITY SENSING MODULE DEVICE

(71) Applicant: Adrian Mongeli, West Hills, CA (US)

(72) Inventor: Adrian Mongeli, West Hills, CA (US)

( * ) Notice: Subject to any disclaimer, the term of this patent is extended or adjusted under 35 U.S.C. 154(b) by 142 days.

(21) Appl. No.: 13/730,254

(22) Filed: Dec. 28, 2012

(65) Prior Publication Data

US 2014/0185277 A1 Jul. 3, 2014

(51) Int. Cl.

| | |
|---|---|
| ***F21L 4/00*** | (2006.01) |
| ***A47G 19/22*** | (2006.01) |
| *F21V 23/04* | (2006.01) |

(52) U.S. Cl.
CPC .. *A47G 19/2227* (2013.01); *A47G 2019/2238* (2013.01); *F21V 23/0471* (2013.01)

(58) Field of Classification Search
CPC ..... A47G 19/2227; A47G 2019/2238
USPC ..... 362/101, 157, 311.01, 382
See application file for complete search history.

(56) References Cited

U.S. PATENT DOCUMENTS

| | | | | |
|---|---|---|---|---|
| 4,922,355 | A * | 5/1990 | Dietz et al. | 362/101 |
| 5,119,279 | A * | 6/1992 | Makowsky | 362/101 |
| 6,163,248 | A * | 12/2000 | Paek | A47G 19/2227 340/321 |
| 6,900,735 | B2 * | 5/2005 | Guerrieri et al. | 340/815.4 |
| 7,954,970 | B2 * | 6/2011 | Goldburt | 362/101 |
| 2003/0081408 | A1 * | 5/2003 | Tai | 362/101 |
| 2006/0044800 | A1 * | 3/2006 | Reime | H05B 33/0803 362/276 |
| 2006/0139928 | A1 * | 6/2006 | Griffiths et al. | 362/276 |
| 2011/0235354 | A1 * | 9/2011 | Glazier | 362/509 |
| 2013/0100652 | A1 * | 4/2013 | Guinon | F21V 3/02 362/184 |
| 2014/0071661 | A1 * | 3/2014 | Zealer | 362/101 |
| 2014/0300273 | A1 * | 10/2014 | LeBrun et al. | 315/76 |

* cited by examiner

*Primary Examiner* — Evan Dzierzynski
(74) *Attorney, Agent, or Firm* — Marcus C. Dawes; Daniel L. Dawes

(57) ABSTRACT

An illuminating motion sensing module for a beverage container. The illuminating motion sensing module is removably coupled to the base of the beverage container. The top surface of the module is comprised of a translucent surface with a diffusion texture which allows light emitted from the module to be propagated into the surrounding environment. The beverage container and motion module are placed on a nightstand, dresser, table, or any other flat surface within a low-light or no-light environment. After the motion of a user has been detected by the module, an illumination pattern is responsively emitted from the module and propagated out of the translucent or transparent beverage container, thus signaling the location of the beverage container to the user in a low-light or no-light environment. The motion module comprises a set of pre-programmed instructions for operating the motion module in one of a plurality of operation modes.

5 Claims, 7 Drawing Sheets

BEVERAGE CONTAINER ILLUMINATED AND CONTROLLED BY MOTION OR PROXIMITY SENSING MODULE DEVICE

BACKGROUND

Field of the Technology

The disclosure relates to the field of motion sensing technology, specifically to beverage containers or other vessels containing motion sensors and lighting.

Description of the Prior Art

Spilled liquids can cause damage to furniture, electronics, or any other susceptible item near the spill area. When good lighting conditions exist a beverage container can easily be seen, chances of knocking over the beverage container and causing a spill are reduced. However during low-light or no-light conditions, it can become very difficult to see a beverage container when reaching for a beverage. This greatly increases the chances of knocking over the beverage container and spilling the liquid contents onto sensitive furniture, electronics, or other susceptible items that are nearby. The chances of accidentally knocking over the beverage container are even higher for certain segments of the population, for example young children, elderly adults, or those with disabilities or other impairments.

Several prior attempts at reducing the chances of spilling liquids in low-light or no-light conditions have been made which have been met with various levels of success. One of these attempts has been to place the beverage container on a coaster containing a night light which is activated by the proximity of a user. Many of these types of devices however comprise a passive infrared sensor (PIR) which sense a 90 degree field of view, meaning that the coaster must first be roughly aligned with the user in order for it to activate. Furthermore, a PIR sensor senses changes in heat regardless of its origin which then leads to false triggers. PIR sensors are also cost prohibitive and require a Fresnel lens, which further increases their complexity and production cost. Additionally, a coaster requires a large footprint, thus limiting its applicability in certain situations. The beverage container must also be carefully placed on the coaster or else the user risks tipping it over, thus destroying the original use of the coaster in the first place.

Other works have included placing bright or flashing lights into various different types of beverage containers for design or aesthetic purposes. Typically these involve placing LED lights or other types of bulbs in or on the bottom of the beverage container and then activating the means for illumination with a push button or switch. Other attempts have simply comprised of painting or fabricating the coaster and/or beverage container with glow in the dark paint.

What is needed is a device for a beverage container which omnidirectionally senses user motion in a field around the beverage container, the device then sufficiently illuminating the beverage container in order to alert its presence and relative location to the user and thus avoiding possible spilling and unnecessary damage to the surrounding area.

BRIEF SUMMARY

An apparatus for providing illumination of a beverage container in a low-light or no-light environment including an illumination and motion sensing module removably coupled to the beverage container. The illumination and motion sensing module includes a sensor for detecting the relative proximity of a user to the beverage container and a LED light source.

In one embodiment, the sensor for detecting the relative proximity of the user to the beverage container is a capacitive contact and proximity sensor.

In another embodiment, the illumination and motion sensing module further includes a diffusive top.

The illumination and motion sensing module in another embodiment further includes a microcontroller coupled to the sensor and to the LED light source. The microcontroller includes a digital storage into which is written a plurality of instructions for controlling operation of the LED light source by the microcontroller in a plurality of operational modes.

In another embodiment, the illumination and motion sensing module further includes a plurality of removable batteries.

In still a further embodiment, the beverage container includes a recess defined with a bottom of the beverage container in which the illumination and motion sensing module may be removably disposed into.

In another specific embodiment, the illumination and motion sensing module includes a bottom surface with a switch disposed thereon.

In another embodiment, the illumination and motion sensing module omnidirectionally detects motion of the user relative to the beverage container in a sensing field around the beverage container.

The invention further includes a method for signaling the location of a translucent or transparent beverage container to a user in low-light or no-light environment. The method includes sensing the motion of the user relative to the beverage container with an illumination and motion sensing module removably coupled to the beverage container, illuminating the beverage container by means of internal reflection from a light source when the user has entered a predetermined proximity to the beverage container, and continuing to illuminate the beverage container according to a preselected operational mode after the user has left the proximity of the beverage container.

In one embodiment, the method step of sensing the motion of the user relative to the beverage container with an illumination and motion sensing module includes omnidirectionally sensing the motion of the user in a sensing field centered about the beverage container.

In another embodiment, the method further comprises selecting one of a plurality of operational modes for illuminating the beverage container by internal illumination. Selecting of the operational mode is done by actuating a switch to activate the illumination and motion sensing module, and then cycling through the plurality of operational modes until a desired operational mode is selected.

In still a further embodiment, the method step of continuing to illuminate the beverage container according to a preselected operational mode after the user has left the proximity of the beverage container includes maintaining the brightness level of the illumination of the beverage container at a maximum level for a predetermined first amount of time. The brightness level of the illumination of the beverage container is then decreased from the maximum level to a minimum level over a predetermined second amount of time. The brightness level of the illumination of the beverage container may be maintained at a maximum for a predetermined time ranging from three seconds to ten minutes. Similarly, decreasing the brightness level of the illumination of the beverage container from the maximum level to a minimum level over a predetermined second amount of time may range from five seconds to ten minutes.

In a separate embodiment, the method step of illuminating the beverage container when the user has approached within a predetermined proximity of the beverage container includes increasing the brightness level of the illumination of the beverage container from a minimum level to a maximum level over a predetermined third amount of time.

In yet another embodiment, the method further includes illuminating the beverage container for as long as the user is within a predetermined proximity of the beverage container.

The invention further includes an illumination apparatus comprising a beverage container, a recess defined within a bottom portion of the beverage container, and a capacitive motion sensing module coupled to the beverage container within the recess.

In one embodiment, the capacitive motion sensing module of the apparatus includes a microcontroller, an LED light source coupled to the microcontroller, a proximity motion sensor coupled to the microcontroller, and a switch coupled to the microcontroller.

Finally, the capacitive motion sensing module of the apparatus includes means for sensing the relative proximity of a user in an omnidirectional field centered about the beverage container.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
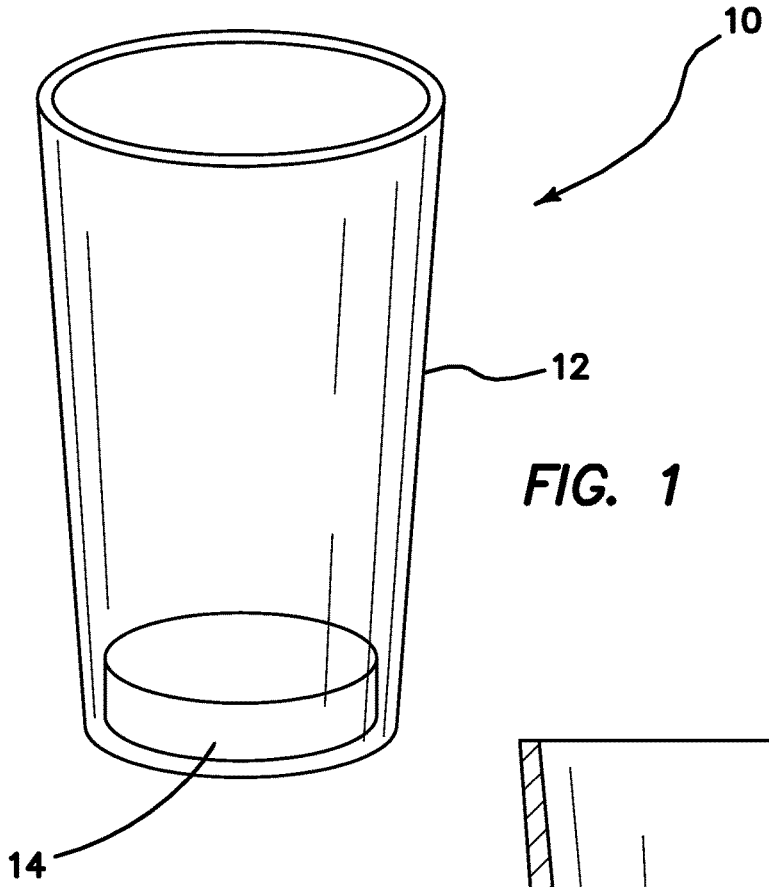
FIG. 1 is a perspective view of the device comprising an illuminating motion module coupled to a beverage container.
Figure 2:
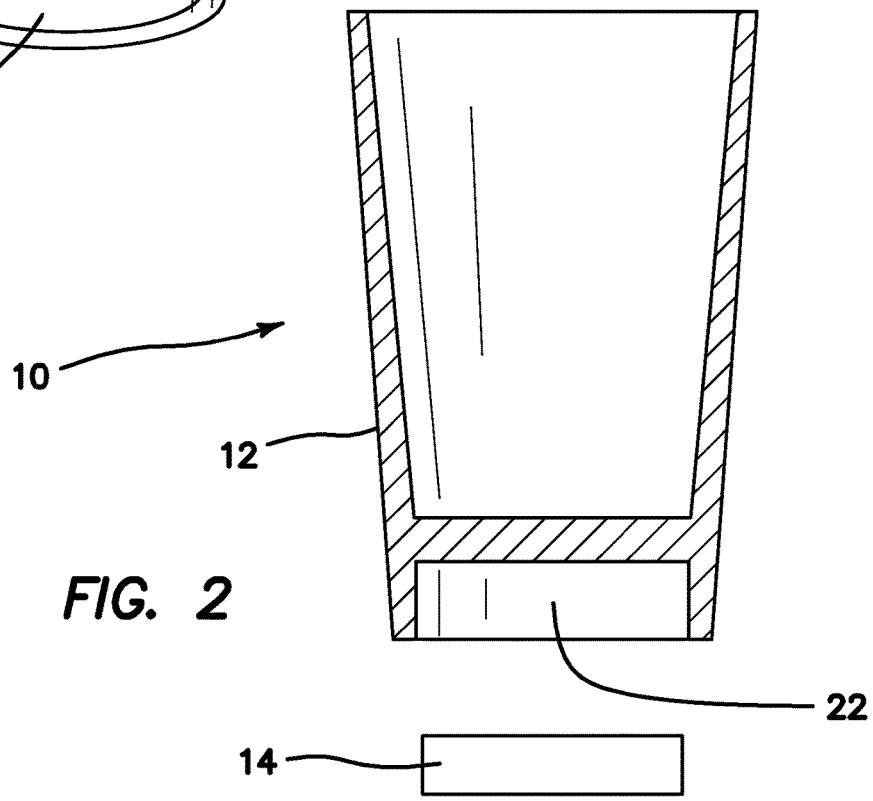
FIG. 2 is a cross sectional view of the device seen in FIG. 1 with the motion module decoupled from the beverage container.
Figure 3:
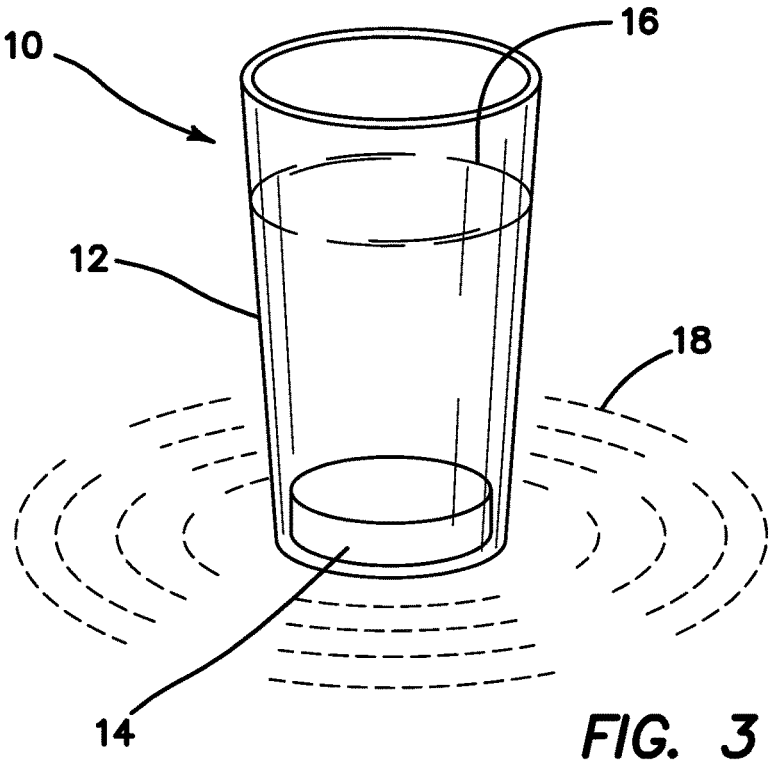
FIG. 3 is a perspective view of the device seen in FIG. 1 when the device contains a liquid and is activated.

Turning to FIG. 1, the current device is shown and is generally denoted with reference numeral 10. The device comprises a beverage container 12 and an illuminating and motion or proximity sensing module 14. The illuminating and motion or proximity sensing module 14 is inserted into or coupled to the base of the beverage container 12 and is removably coupled thereto. The beverage container 12 may be comprised of glass, plastic, stainless steel, or of any other material that is safe to drink from. Further, the illuminating motion or proximity sensing module 14 is enclosed in a translucent plastic material known in the art. In FIGS. 1-3 the beverage container 12 is seen as a standard pint glass, however other beverage containers now known or later devised such as plastic zippy cups, mugs, martini glasses, bottles, and the like may also be used without departing from the original spirit and scope of the invention. Preferably the container 12 is transparent or translucent so that the light from module 14 is coupled at least partially into the walls of container 12, and multiply reflected therein so that it serves as a light pipe to illuminate the entire container 12, making its entire or a substantial portion of its outline clearly visible in the low light or dark environment. In this manner the user can clearly perceive the location and orientation of container 12, making container 12 readily accessible notwithstanding that it could not be easily otherwise located in the low light or dark environment, but for the operation of module 14 in combination with container 12.

In one embodiment shown in FIG. 2, a cross section of the beverage container 12 is seen with the illuminating motion or proximity sensing module 14 removed. In this embodiment, the beverage container 12 comprises a recess 22 defined in its bottom portion. The recess 22 is substantially circular shaped and is defined within the beverage container 12 so as to envelope the illuminating motion module 14 when the illuminating motion module 14 is coupled to the beverage container 12. The illumination and motion module 14 is removably coupled to the beverage container 12 so that the beverage container 12 may be washed or stored while the illuminating motion module 14 remains protected. The motion module 14 may also be removed from the beverage container 12 in order to facilitate the replacement of the batteries 34 of the motion module 14.

Figure 4:
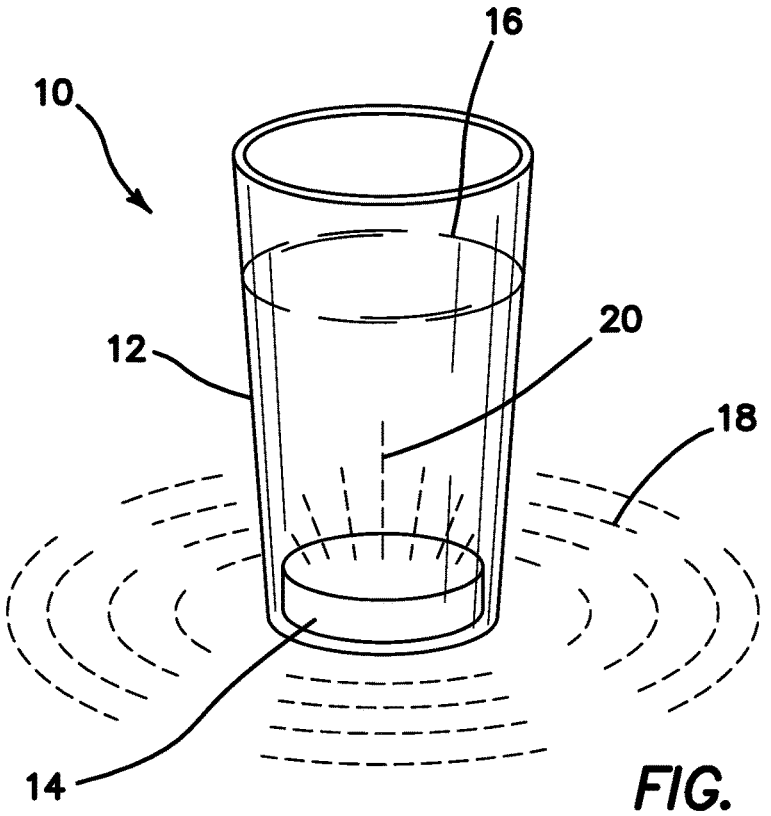
FIG. 4 is a perspective view of the device seen in FIG. 3 after the motion module has detected user movement and has illuminated the beverage container.

Turning to FIG. 3, the illuminating motion module 14 is coupled to the beverage container 12. The beverage container 12 is shown with a liquid 16 inside. After the illuminating motion module 14 has been activated by user motion, a sensing field 18 is emitted from the illumination and motion module 14 in an omnidirectional pattern around the beverage container 12. While FIG. 3 shows the sensing field 18 as a substantially circular pattern about the beverage container 12 on a flat surface, it is to be expressly understood that the sensing field 18 is actually disposed about the illuminating motion module 14 in a substantially spherical pattern about the beverage container 12. This allows the illuminating motion module 14 to be activated regardless of the relative angle between the motion of the user and the beverage container 12. After the motion of a user has been detected by the illuminating motion module 14, an illumination pattern 20 is responsively emitted from the illuminating motion module 14 as seen in FIG. 4. The illumination pattern 20 is propagated through the liquid 16 and out of the translucent or transparent beverage container 12, thus signaling the location of the beverage container 12 to the user in a low-light or no-light environment.

Figure 5A:
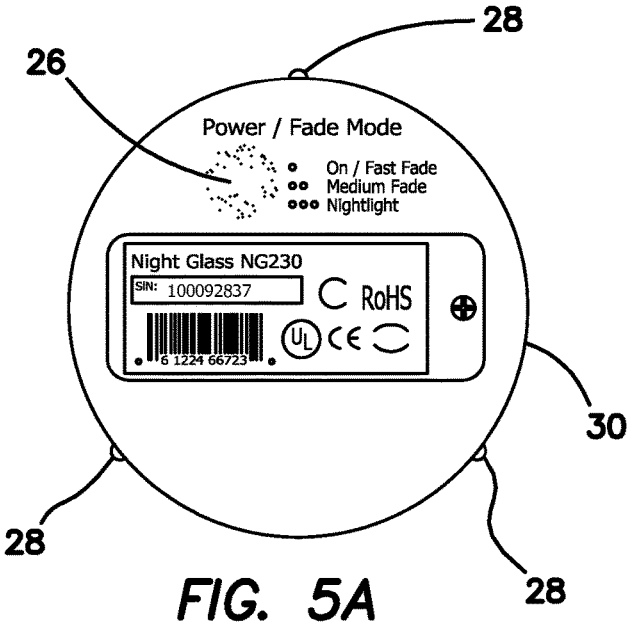
FIG. 5A is a bottom view of the motion module used in the current device.
Figure 5B:
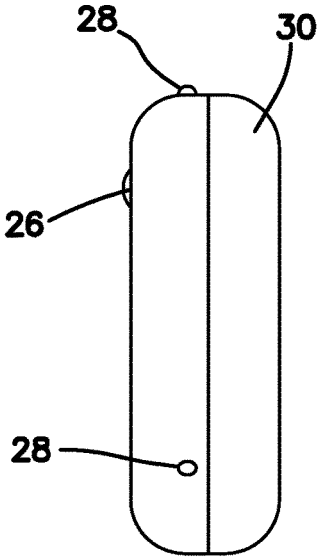
FIG. 5B is a side view of the motion module seen in FIG. 5A.
Figure 5C:
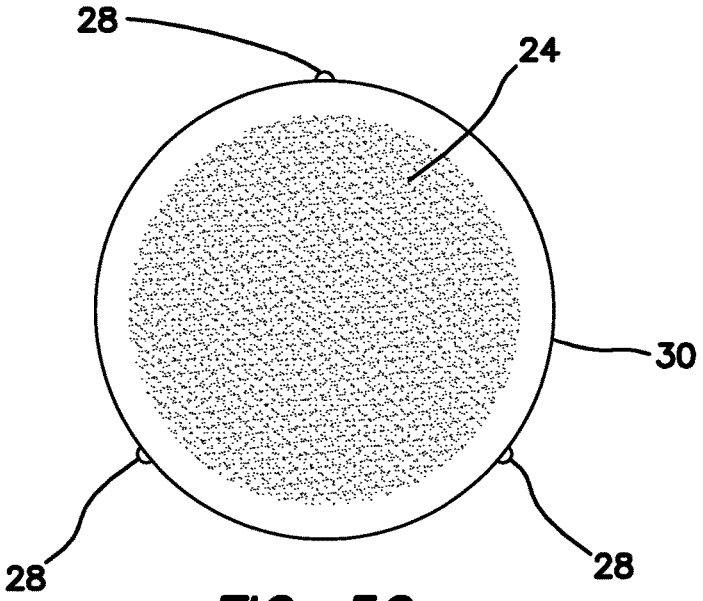
FIG. 5C is a top view of the motion module seen in FIG. 5A.

Greater understanding of the illuminating motion module 14 may be had by turning to FIGS. 5A-5E and 6A-6E. The illuminating motion module 14 is substantially circular in shape and comprises a housing 30 made of light weight durable plastic or plastic composites. The top surface of the module 14 seen in FIG. 5C is comprised of a translucent surface 24 with a diffusion texture which allows light emitted from the internal components of the module 14 to be propagated into the surrounding environment. The bottom surface of the module 14 seen in FIG. 5D comprises a proximity sensor or "touch switch" 50. The touch switch 50 is incorporated into the circuit board 36 and is electrically coupled to a plurality of batteries 34. When a user places their finger roughly 0.25 inches away, the touch switch 50 senses the user's proximity to the module 14 and actuates the module 14. Also disposed about the housing 30 of the motion module 14 are a plurality of feet 28 which assist the motion module 14 to be slid into and maintain surface contact with the recess 22 of the beverage container 12.

FIG. 5A shows an alternative embodiment of the module 14 which comprises a raised bubble push button 26. The bottom portion of the circuit board 36 comprises a tact switch 32 electrically coupled to the plurality of batteries 34. A push button 26 is disposed above the tact switch 32 so that when actuated by a user, the push button 26 will in turn actuate the tact switch 32.

Figure 6A:
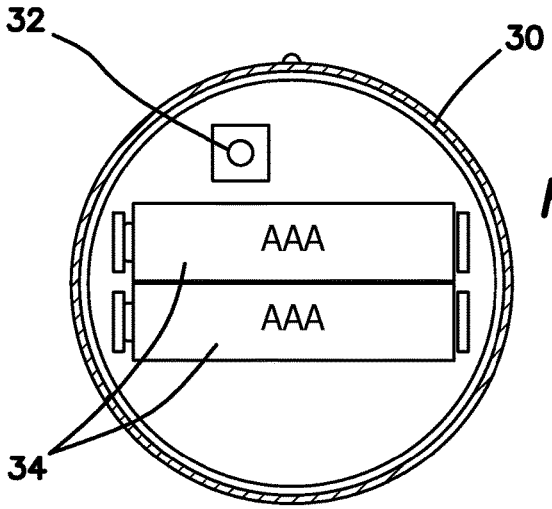
FIG. 6A is a bottom cross sectional view of the motion module seen in FIG. 5A.
Figure 6B:
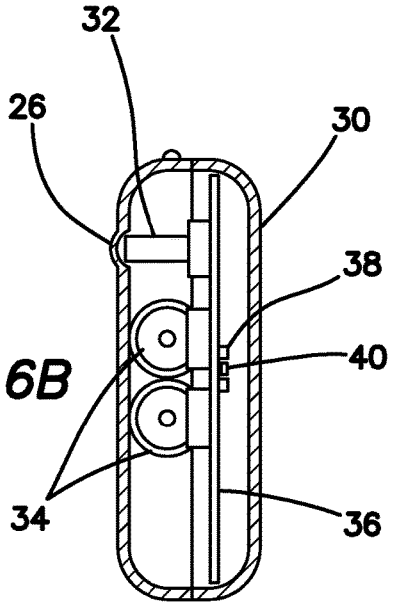
FIG. 6B is a side cross sectional view of the motion module seen in FIG. 5B.
Figure 6C:
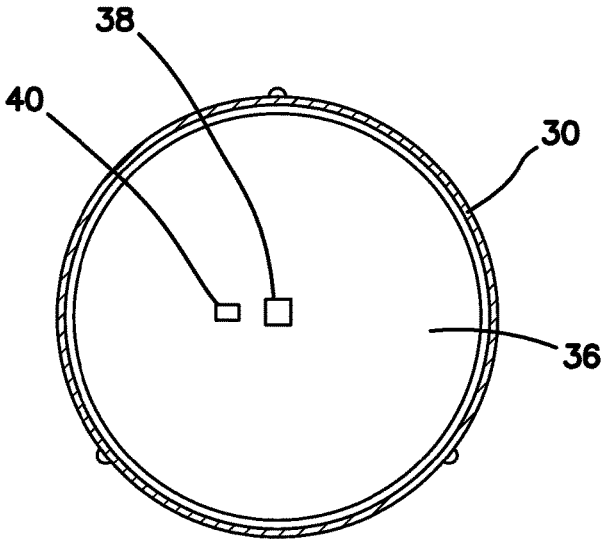
FIG. 6C is a top cross sectional view of the motion module seen in FIG. 5C.
Figure 5D:
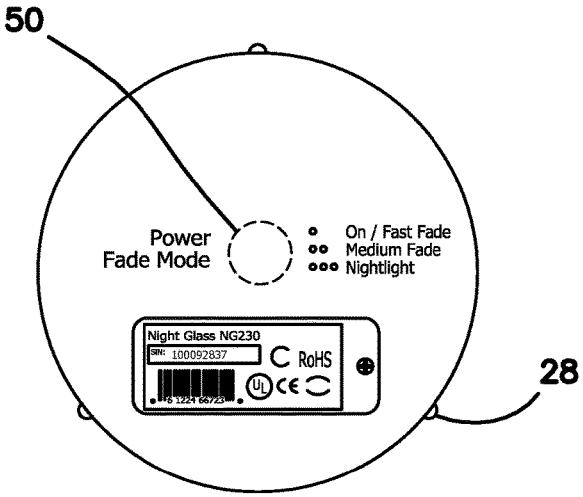
FIG. 5D is a bottom view of an alternative embodiment of the motion module comprising a touch switch.
Figure 5E:
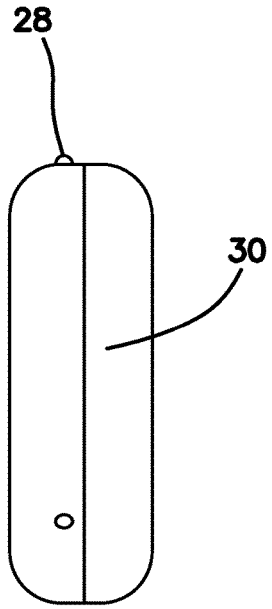
FIG. 5E is a side view of the alternative motion module seen in FIG. 5D.

Coupled to the top portion of the circuit board 36 is a LED 40 and a capacitive contact and proximity sensor 38 seen in FIG. 6C. Alternatively, the proximity sensor 38 used may be the same capacitive sensor used for the touch switch 50. The capacitive contact and proximity sensor 38 and sensor used for the touch switch 50 is any sensor known in the art capable of detecting motion based on the changing capacitance of the surrounding environment, such as the IQS152 motion sensor manufactured by AZOTEQ®.

Figure 6D:
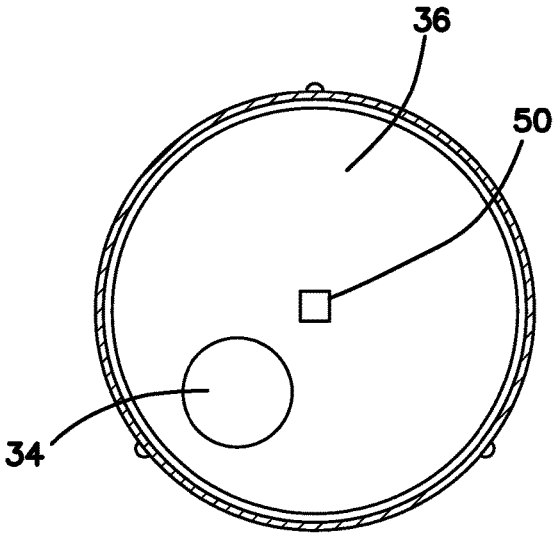
FIG. 6D is a bottom cross sectional view of an alternative embodiment of the motion module comprising a touch switch.
Figure 6E:
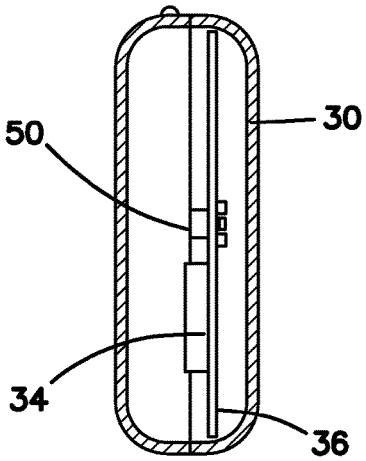
FIG. 6E is a side cross sectional view of the alternative motion module seen in FIG. 6D.

It is important to note that the batteries 34 disposed within the module 14 may be any type of batteries now known in the art or later devised, such as for example standard double-A sized batteries seen in FIGS. 6A and 6B, or a watch or coin-type battery seen in FIGS. 6D and 6E.

Figure 8:
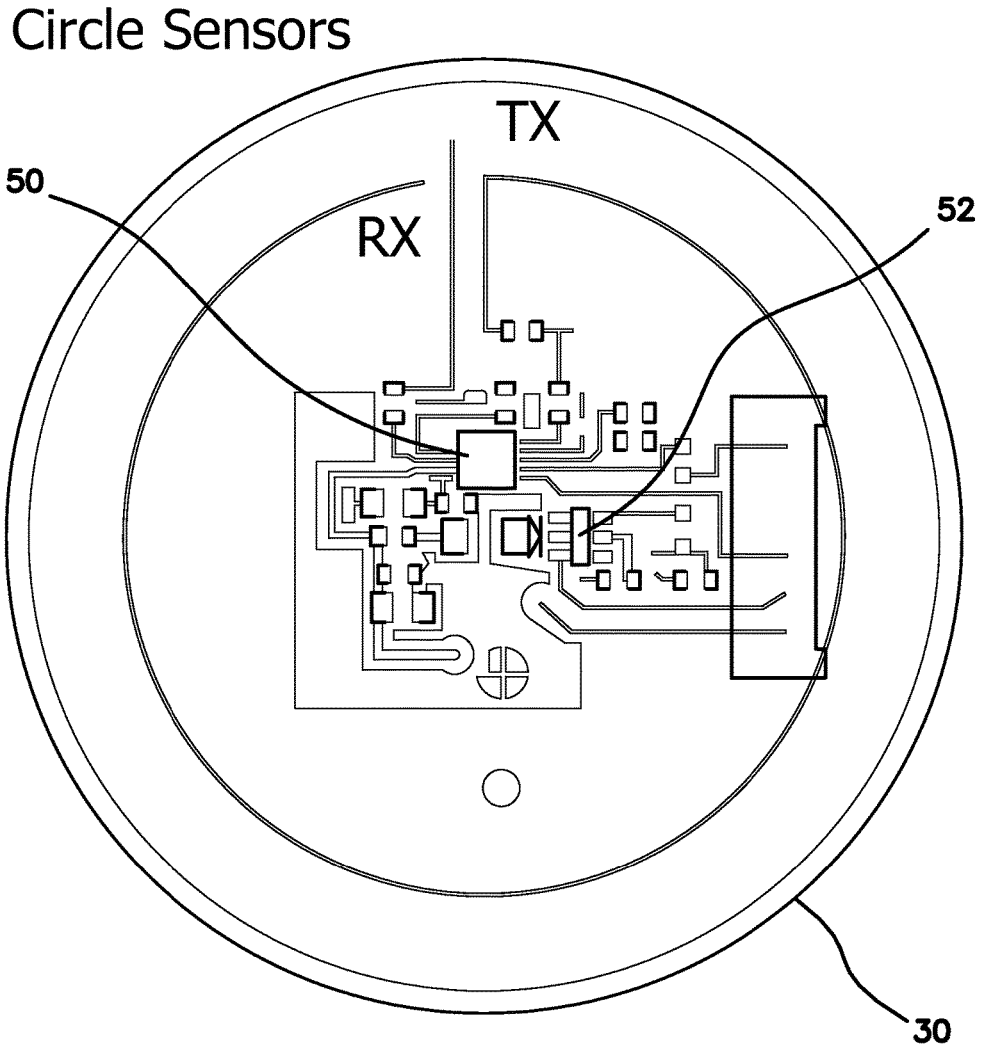
FIG. 8 is a top cross sectional view of the motion module showing the internal circuitry comprising a microcontroller.

Internally, the motion module 14 comprises a circuit board 36 disposed within the housing 30 as seen in FIGS. 6A-6E. The circuit board 36 also comprises a microcontroller or central processing unit 52 seen in FIG. 8 which is coupled to the tact switch 32 or touch switch 50, LED 40, and the capacitive contact and proximity sensor 38 as seen in FIGS. 6A-6C. The microcontroller 52 comprises a memory chip, such as a RAM or ROM chip as is known in the art, which contains a set of pre-programmed instructions for operating the motion module 14 in one of a plurality of operation modes.

Figure 7:
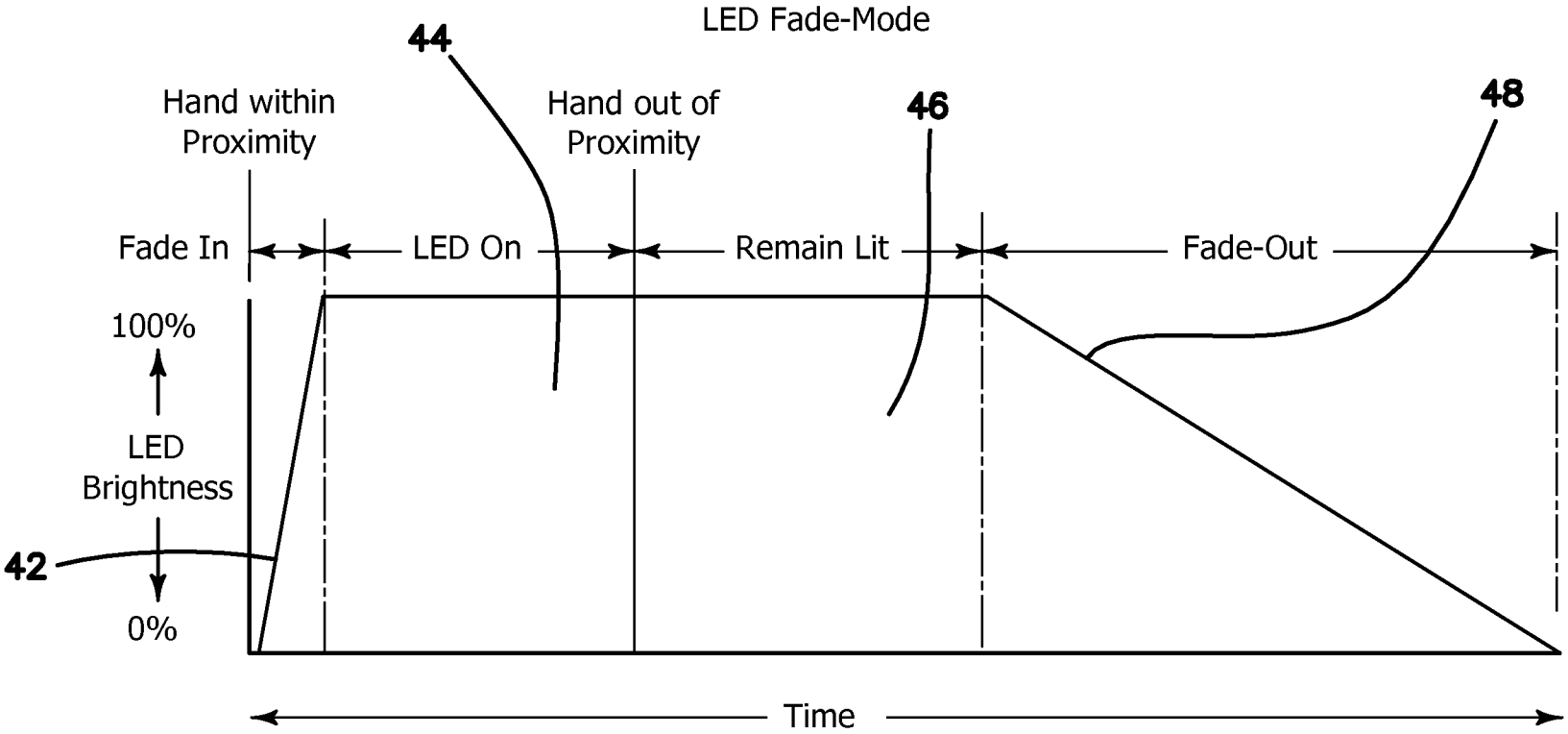
FIG. 7 is a graphical representation of the brightness of the LED of the motion module versus elapsed time for a generalized operational mode of the motion module.

The motion module 14 is operated by coupling the motion module 14 to the beverage container 12 when the motion module 14 is in one of a plurality of operational modes. The device 10 is placed on a nightstand, dresser, table, or any other flat surface within a low-light or no-light environment. When a user approaches the device 10, their presence is detected by the capacitive contact and proximity sensor 38, which sends a signal to the microcontroller 52. The microcontroller 52 in turn sends a signal to the LED 40, causing the LED 40 to illuminate according to the present operational mode as determined by the microcontroller 52. In one preferred embodiment, the operational mode of the LED 40 comprises several different illumination stages as seen in FIG. 7. When initially activated, the LED 40 will "fade in" or quickly increase from zero to 100% brightness along slope 42. As long as the user remains within close proximity to the device, the LED 40 remains lit at the maximum brightness as seen in portion 44 of the graph in FIG. 7. After the user exits the proximity of the device 10 as determined by the sensor 38, the LED 40 will remain lit for a predetermined amount of time as seen in the "remain lit" portion 46 of the graph in FIG. 7. Finally, after the predetermined amount of time has elapsed, the LED 40 will "fade out" or decrease from 100% brightness to zero along slope 48 over a period of time. In one preferred embodiment, slope 42 is much higher than slope 48, meaning that the "fade in" time for the LED 40 is much faster and more instantaneous than its "fade out" time.

Upon actuation of the touch switch 50, a signal is sent to the microcontroller 52 via the touch switch 50 to enter one of the plurality operation modes stored on within the internal memory of the microcontroller 52. The user may actuate the touch switch 50 again, signaling the microcontroller 52 to cycle to the next operation mode. The user may continue to actuate the touch switch 50 until the desired operation mode is selected. Once the microcontroller 52 has been cycled through the list of possible operation modes, the microcontroller 52 begins again at the beginning of the list, allowing the user to cycle through the modes ad infinitum.

In one embodiment, one of the plurality of operation modes is a "fast" fade mode. In this mode, the "remain lit" portion 46 of the graph of FIG. 7 lasts for approximately three seconds before the motion module 14 enters the "fade-out" slope 48, which in turn lasts for approximately five seconds. In other words, the LED 40 remains lit for a total of eight seconds after the user's hand has exited the proximity of detection of the motion module 14 before being completely extinguished.

In another embodiment, one of the plurality of operation modes is a "medium" fade mode. In this mode, the "remain lit" portion 46 of the graph of FIG. 7 lasts for approximately ten seconds before the motion module 14 enters the "fade-out" slope 48, which in turn lasts for approximately five seconds. In other words, the LED 40 remains lit for a total of fifteen seconds after the user's hand has exited the proximity of detection of the motion module 14 before being completely extinguished.

In yet another embodiment, one of the plurality of operation modes is a "nightlight" fade mode. In this mode, the "remain lit" portion 46 of the graph of FIG. 7 lasts for approximately ten minutes before the motion module 14 enters the "fade-out" slope 48, which in turn lasts for approximately ten more minutes. This particular mode then serves to make the beverage container 12 and motion module 14 an effective nightlight, i.e., a light of low intensity within a low-light or no-light environment. It should be expressly noted however that other operation modes comprising different operational phases or phase durations not described herein may be used without departing from the original spirit and scope of the invention. For example, the microcontroller 52 may comprise an operation mode where the LED 40 is illuminated consistently for ten minutes without any fading characteristics at all.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. A system for providing illumination in a low-light or no-light environment comprising:

a beverage container, wherein the beverage container comprises:

a circular recess defined in a bottom portion of the beverage container; and a motion sensing module, the motion sending module comprising:

a housing comprising a top surface, a bottom surface, and a rounded wall disposed between the top surface and the bottom surface, wherein the housing comprises a circular cross section;

a diffusion texture defined into the top surface of the housing;

a plurality of feet disposed symmetrically about the rounded wall of the housing;

a circuit board disposed within the housing between the bottom surface and the top surface;

a microcontroller coupled to the circuit board;

a touch switch disposed on the bottom surface of the housing and coupled to the microcontroller;

a plurality of batteries coupled to the microcontroller and disposed between the bottom surface of the housing and the circuit board; and a LED light source disposed adjacent to the diffusion texture defined in the top surface of the housing and coupled to the circuit board, wherein the plurality of feet disposed symmetrically about the rounded wall of the housing are configured to form a removable continuous pressure-fitted coupling between an outer circumference of the motion sensing module and an inner circumferential wall of the circular recess defined within the bottom of the beverage container, wherein the circular recess defined in a bottom portion of the beverage container comprises at least one translucent inner surface and is configured to accommodate the housing of the motion sensing module, wherein the diffusion texture defined into the top surface of the housing is configured to propagate light emitted from the LED light source in a spherical pattern radiating from the motion sensing module, and wherein the touch switch disposed on the bottom surface of the housing and coupled to the microcontroller is configured to activate the LED light source when a portion of the body of the user is detected at a first distance relative to the touch switch, and wherein the touch switch is configured to cycle through a plurality of operational modes stored within the microcontroller when a portion of the body of the user is detected at a second distance relative to the touch switch, the second distance relative to the beverage container being smaller than the first distance relative to the beverage container.

2. The system of claim 1 wherein the motion sensing module is removably inserted into the recess defined in the bottom portion of the beverage container, and wherein the motion sensing module comprises a rounded top and bottom surface in the Y-plane.

3. The system of claim 1 wherein the microcontroller is further coupled to the sensor and to the LED.

4. The system of claim 3 wherein the microcontroller comprises a digital storage into which is contained a plurality of instructions for controlling operation of the LED by the microcontroller in a plurality of operational modes.

5. The system of claim 1 wherein the touch sensor omnidirectionally detects motion of a portion of the body of the user relative to the beverage container in a sensing field around the beverage container.

* * * * *